US010039383B2

(12) United States Patent
Winikoff

(10) Patent No.: US 10,039,383 B2
(45) Date of Patent: Aug. 7, 2018

(54) MOUNTING ASSEMBLY

(71) Applicant: Robert Winikoff, Cote Ste. Luc (CA)

(72) Inventor: Robert Winikoff, Cote Ste. Luc (CA)

( * ) Notice: Subject to any disclaimer, the term of this patent is extended or adjusted under 35 U.S.C. 154(b) by 0 days.

(21) Appl. No.: 14/998,764

(22) Filed: Feb. 10, 2016

(65) Prior Publication Data

US 2017/0227161 A1 Aug. 10, 2017

(51) Int. Cl.

| | |
|---|---|
| ***B65D 25/24*** | (2006.01) |
| ***A47B 95/00*** | (2006.01) |
| ***A47B 96/06*** | (2006.01) |
| ***A47B 96/07*** | (2006.01) |

(52) U.S. Cl.

CPC ..... *A47B 95/008* (2013.01); *A47B 96/067* (2013.01); *A47B 96/07* (2013.01)

(58) Field of Classification Search

CPC ..... F16M 13/02; A47B 95/00; A47B 96/06; A47B 96/025; A47B 45/00; A47B 57/42; A47B 57/06; A47B 88/00; A47B 63/00; B65D 25/20; B65D 25/22; B25B 1/02; B25B 5/02; F16B 2/12; H05K 5/00

USPC ..... 220/476, 3.2–3.94; 211/94.02, 162, 208, 211/175, 119.003, 153, 7, 184; 403/107; 248/297.21, 297.31, 295.11, 298.1, 274.1, 248/307, 304; 174/480–507, 50–50.59; 70/79, DIG. 11, DIG. 81

See application file for complete search history.

(56) References Cited

U.S. PATENT DOCUMENTS 2,947,566 A * 8/1960 Tower ..... B60P 3/42 211/182

3,148,698 A * 9/1964 Arnold ..... D06F 39/08 137/360

* cited by examiner

*Primary Examiner* — Anthony Stashick
*Assistant Examiner* — James M Van Buskirk
(74) *Attorney, Agent, or Firm* — Praxis

(57) ABSTRACT

A mounting assembly having a mounting wall and at least first and second mounting members mounted on the mounting wall, the members extending in opposite directions from each other and away from the mounting wall. The mounting members have front edges spaced from the mounting wall. The first mounting member is slidably mounted through a first channel member on the mounting wall, the first mounting member movable relative to the second mounting member to be able to vary the distance between their front edges.

1 Claim, 6 Drawing Sheets

MOUNTING ASSEMBLY

BACKGROUND OF THE INVENTION

1. Field of the Invention

This invention is directed toward a mounting assembly constructed to be mounted on two spaced-apart supports with the assembly between the supports. The mounting assembly is adjustable in width so it can be mounted to supports which can be different distances apart.

The invention is particularly directed toward a mounting assembly having a container, the mounting assembly constructed to be mounted on two spaced-apart, parallel supports with the container in the space between the supports. The mounting assembly is adjustable in width so it can be mounted to supports which can be different distances apart.

2. Description of the Related Art

It often desirable to mount an article retainer, such as a shelf or container, on the back of a cupboard door. The door often is thick enough so that the shelf or container can be easily fastened to the back of the door with fasteners. Often however, the door consists of a thin panel mounted on a peripheral frame. It is difficult to mount anything on the back of the panel using fasteners since the fasteners would penetrate the panel and mar the outer appearance of the door. The article retainer could be mounted on one side or the other of the peripheral frame of the door but then the retainer could be less accessible through the opening normally closed by the door, or alternatively, more intrusive into the opening, depending on which side of the frame it is mounted on.

There are also occasions where it is desirable to mount a mounting assembly within the space between two vertical supports of a window frame, a doorway, or a similar construction. The mounting assembly can carry information that is visible to a person passing by the mounting assembly. Such a mounting assembly is however normally custom built to fit the spacing of the two vertical supports and thus is relatively expensive.

SUMMARY OF THE INVENTION

It is the purpose of the present invention to provide a mounting assembly having a mounting wall and at least two mounting members on the mounting wall that permit the mounting assembly to be fastened to two spaced-apart supports to locate the mounting wall within the space between the supports. The mounting members extend laterally from the mounting wall of the mounting assembly, in opposite directions, toward the supports. At least one of the members is slidable to be able to adjust the distance between the front ends of the mounting members.

It is another purpose of the present invention to provide a mounting assembly having a mounting wall, a container on wall, and at least two spaced-apart mounting members on the wall. The mounting members permit the mounting assembly to be mounted between two spaced apart supports with the container located in the space between the supports. The mounting members extend laterally from the mounting wall of the mounting assembly in opposite directions. At least one of the mounting members is slidable to be able to adjust the distance between the front ends of the mounting members. In one embodiment, the container is attached to the front of the mounting wall. In another embodiment the mounting wall of the assembly forms the back wall of the container.

The invention is particularly directed toward a mounting assembly having a mounting wall. At least first and second mounting members are mounted on the mounting wall. The members extend in opposite directions from each other and away from the mounting wall with their front ends normally spaced from the mounting wall. The first mounting member is slidably mounted in a first channel member on the mounting wall. The first mounting member is movable relative to the second mounting member to be able to vary the distance between their front ends.

DESCRIPTION OF PREFERRED EMBODIMENT

Figure 1:
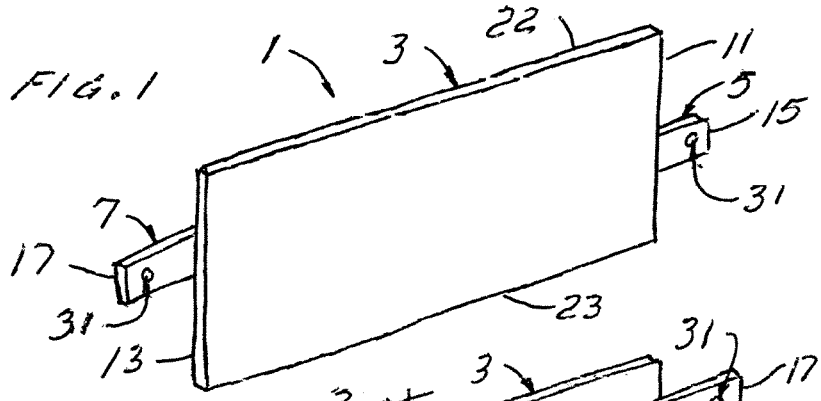
FIG. 1 is a front perspective view of the mounting assembly.
Figure 2:
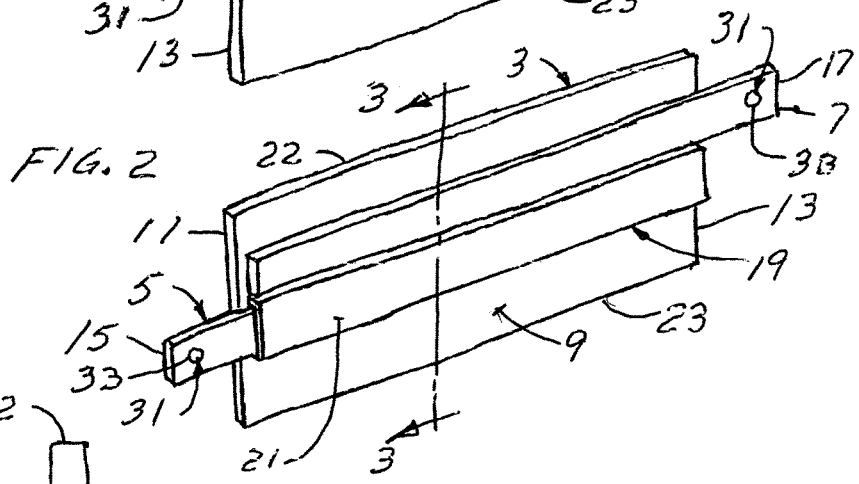
FIG. 2 is a rear perspective view of the mounting assembly.
Figure 3:
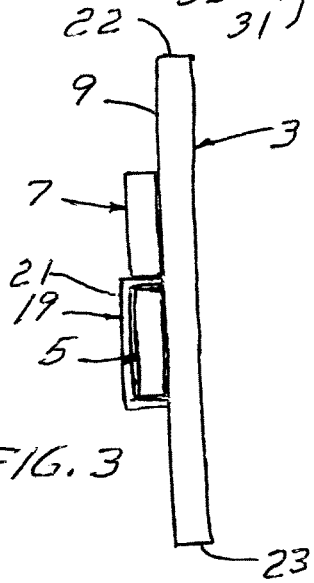
FIG. 3 is a cross-section view taken along line 3-3 in FIG. 2.

As shown in FIGS. 1-3, the mounting assembly 1, in the simplest embodiment, has a rigid mounting wall 3. The mounting wall 3 is normally quadratic. The mounting assembly 1 has at least two mounting members 5, 7 mounted on its mounting wall 3. The mounting members 5, 7 are in the form of thin, relatively rigid, narrow plates and are preferably mounted on the back 9 of the mounting wall 3. The mounting members 5, 7 are preferably identical and are shown as extending across the width of the mounting wall 3 and slightly beyond, the one mounting member 5 projecting past one side 11 of the mounting wall and the other mounting member 7 projecting past the other side 13 of the mounting wall 3. The mounting members 5, 7 terminate in front ends 15, 17 normally spaced a short distance from the sides 11, 13 respectively of the mounting wall 3.

At least one of the mounting members 5, 7 is slidably mounted on the mounting wall 3. The mounting member 5 is shown as snugly, slidably mounted through a channel 19 on the back 9 of the mounting wall 3. The channel 19 can be integral with the mounting wall 3 as shown. Alternatively, the channel 19 can be formed by a separate tubular member (not shown) attached to the back 9 of the mounting wall 3 by suitable means. The slidable mounting member 5 can be moved in the channel 19 to extend a required distance past the side 11 of the mounting wall 3. The channel 19 has been shown as being closed. However it could also have a major portion of its back wall 21 removed to provide an open channel.

The other mounting member 7 is attached directly to the mounting wall 3 by suitable fastening means (not shown). The fixed mounting member 7 can extend a short distance past the side 13 of the mounting wall 3 or can extend for most of its length from the wall or any distance in between. The fixed mounting member 7 can be mounted adjacent the channel 19 carrying the sliding mounting member 5. The mounting members 5, 7 preferably are generally centrally located on mounting wall 3 about midway between the top and bottom 22, 23 of the wall 3.

Figure 4:
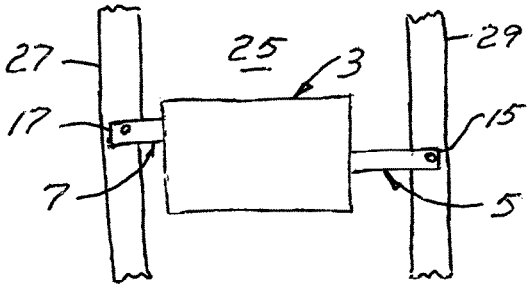
FIG. 4 is a front view of the mounted mounting assembly.

The mounting assembly 1 is adapted to be mounted in the space 25 between spaced-apart supports 27, 29 as shown in FIG. 4. The movable mounting member 5 is normally pulled part-way out of the channel 19 past the side edge 11 of the mounting wall 3 a distance sufficient to locate the front ends 15, 17 of the mounting members 5, 7 on the supports 27, 29 respectively. Connecting means 31 connect the mounting members 5, 7 to the supports 27, 29.

The connecting means 31 can include fastener receiving means 33 on the mounting members 5, 7 adjacent their front ends 15, 17 as shown in FIGS. 1-2. The fastener receiving means 33 can be holes, as shown, through which fasteners (not shown) are inserted to fasten the front ends of the mounting members 5, 7 to the spaced-apart supports 27, 29 respectively. When the mounting assembly 1 has been fastened to the supports 27, 29, the mounting wall 3 is fixedly located in the space 25 between the supports 27, 29. Other connecting means can be used.

Figure 5:
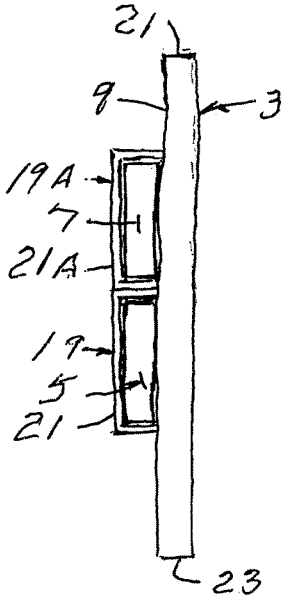
FIG. 5 is a cross-section view similar to FIG. 3 showing a modified mounting assembly.

The mounting assembly 1 preferably has both mounting members 5, 7 snugly, slidably mounted in channels 19, 19A respectively as shown in FIG. 5. The channel 19A is preferably adjacent the channel 19 on the back 9 of the mounting wall 3. The channel 19A can also be formed integral with the mounting wall 3 of the mounting assembly 1. Alternatively, the channel 19A can be formed separately and attached to the back of the mounting wall 3. In another embodiment, not shown, the channel 19A could be mounted on the back wall 21 of channel 19 instead of on the back 9 of the mounting wall 3. With both mounting members 5, 7 slidable, the mounting assembly has greater length adjustment than a mounting assembly with only one sliding mounting member. The mounting assembly 1 can be mounted on supports 27, 29 spaced-apart a distance ranging between slightly greater than the width of the mounting assembly, with the mounting members 5, 7 withdrawn, to slightly less than three times the width of the mounting wall 3 with the mounting members 5, 7 extended from the channels 19, 19A.

Figure 6:
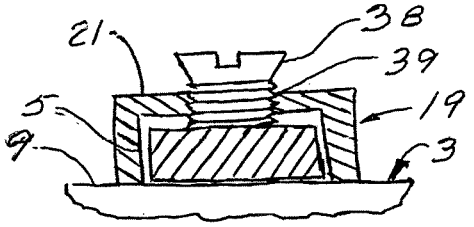
FIG. 6 is a detail view of a locking mechanism for the mounting members.

With both mounting members 5, 7 slidable, locking means 37 are provided to lock at least one of the mounting members 5, 7 to the mounting wall 3 to prevent sliding movement of the mounting wall 3 on the mounting members. As shown in FIG. 6, the locking means 37 can comprise a screw 38, threaded through hole 39 the back wall 21, 21A of one of the channels 19, 19A to press against the mounting member 5, 7 in the one channel member to lock the mounting wall 3, via its connection to the selected channel member, to the selected mounting member 5, 7 and prevent inadvertent movement of the mounting wall relative to the mounting members. Other locking means can be used.

Figure 7:
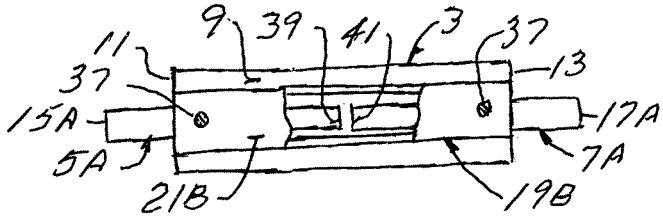
FIG. 7 is rear view, partly broken away, of the mounting assembly with mounting members back-to-back.

If the mounting wall 3 of the mounting assembly 1 is relatively wide between its sides 11, 13, the slidable mounting members 5A, 7A can be built to share a channel 19B located on the back 9 of mounting wall 3 as shown in FIG. 7. The mounting members 5A, 7A each have a length that is a little more than half the width of the mounting wall 3 between the sides 11, 13. The mounting members 5A, 7A are mounted back to back within the channel 19B with their rear ends 39, 41 respectively, normally adjacent. The front ends 15A, 17A of the mounting members 5A, 7A respectively are normally a short distance past the sides 11, 13 of the mounting wall 3 when the mounting assembly is not being used. In use, the mounting members 5A, 7A are moved to extend outwardly, from the common channel 19B in opposite directions, about the same distance to be able to mount the mounting wall 3 generally centrally in the space 25 between spaced-apart supports 27, 29. In this embodiment the mounting assembly 1 can be mounted on supports 27, 29 spaced-apart a maximum distance almost equal to two times the width of the mounting wall 3. Again, a locking means 37 could be provided, extending through the back wall 21B of channel 19B to lock one of the mounting members in position relative to the mounting wall 3 to prevent the mounting wall 3 from sliding on the mounting members 5A, 7A when mounted on the members.

Figure 8:
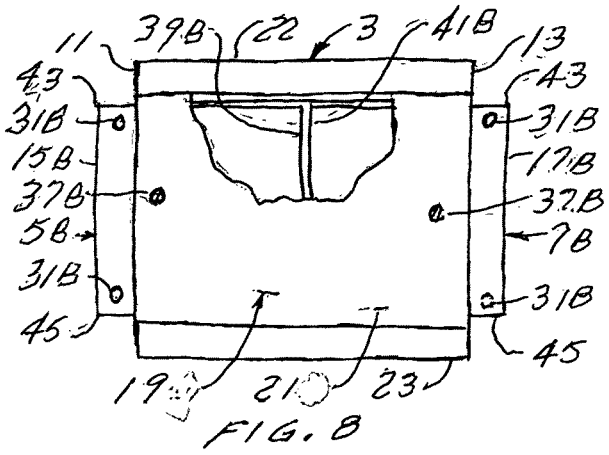
FIG. 8 is a rear view, similar to FIG. 7, but with the mounting members expanded in height.

The mounting wall 3 of the mounting assembly 1 can be relatively long between the top and bottom 22, 23 of the mounting wall 3. The mounting members 5B, 7B can be made relatively long to extend over nearly all of the mounting wall 3, within a long channel 19C, as shown in FIG. 8. The mounting members 5B, 7B could each have a rectangular shape and extend a short distance past the sides 11, 13 respectively of the mounting wall 3 terminating in long front ends 15B, 17B. The rear ends 39B, 41B of the members 5B, 7B would normally be adjacent within the channel 19C. Each member 5B, 7B would have connecting means 31B at their upper and lower corners 43, 45 at their front edges 15B, 17B respectively. Mounting the relatively long quadratic mounting assembly 1 near its four corners 43, 45 provides a rigid, stable assembly when it is attached to the supports 27, 29. Locking means 37B would extend through the back wall 21C of the channel 19C to lock the mounting wall 3 against sliding movement relative to the mounting members 5B, 7B.

Figure 9:
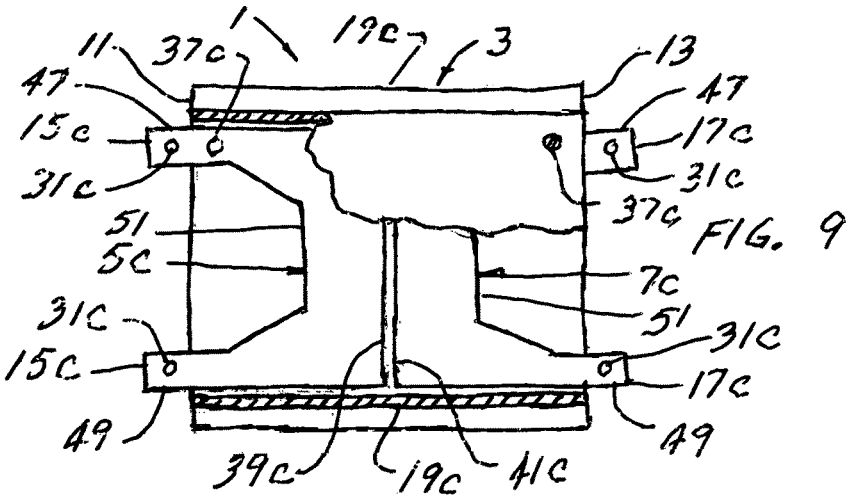
FIG. 9 is a rear view, similar to FIG. 8, with the back wall partially removed, and the front of the mounting members modified.

Preferably the mounting members 5C, 7C in the mounting assembly 1 can each be shaped to have top and bottom arms 47, 49 extending outwardly from the top and bottom ends of a narrow base 51 as shown in FIG. 9 to save material. The mounting members 5C, 7C are back to back with the rear ends 39C, 41C of the bases 51 adjacent and are slidably mounted in a common channel 19C which normally covers most of the mounting wall 3. The front edges 15C, 17C of the arms 47, 49 of the mounting members 5C, 7C extend just past the sides 11, 13 of the mounting wall 3 when the mounting assembly 1 is not in use. The mounting members 5C, 7C can each have connecting means means 31C at the ends of their arms 47, 49 adjacent their front edges 15C, 17C for use in fastening the mounting assembly to the spaced apart supports 27, 29. Locking means 37C can again be used to lock one of the mounting members 5C, 7C to the mounting wall 3 to prevent sliding of the mounting wall 3 on the mounting members.

Figure 10:
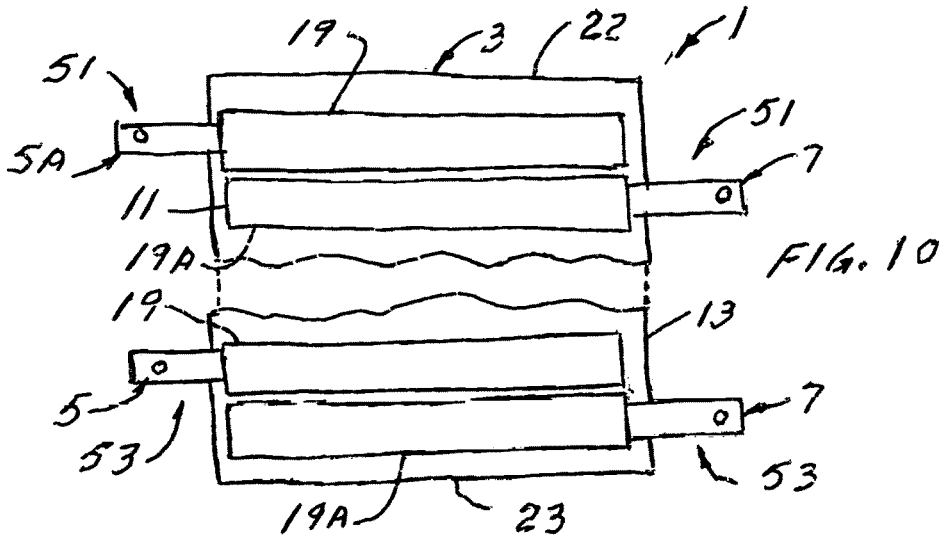
FIG. 10 is a broken, rear view of a mounting assembly with top and bottom sets of side-by-side mounting members on the mounting wall.

If the mounting assembly 1 is quite long, between the top and bottom 22, 23 of the mounting wall 3, the mounting assembly 1 could have top and bottom pairs 51, 53 of adjacent, mounting members 5, 7 as shown in FIG. 10. The top pair 51, adjacent the top 22 of the mounting wall 3, has two mounting members 5, 7, one above the other, each extending across the width of the mounting wall 3. At least one mounting member 5, and preferably both, are slidably mounted in a channels 19, 19A. The bottom pair 53, adjacent the bottom 23 of the mounting wall 3, also has two mounting members 5, 7, one above the other, also extending across the width of the mounting wall 3. At least one mounting member 5, and preferably both, of the bottom pair 53 are slidably mounted in second channel members 19, 19A.

Figure 11:
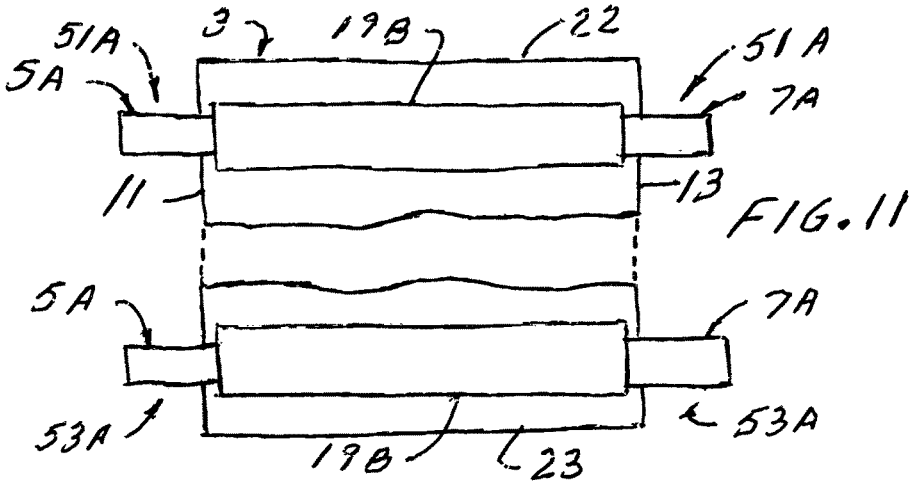
FIG. 11 is a broken, rear view of a mounting assembly with top and bottom sets of back-to-back mounting members on the mounting wall.

In another embodiment, as shown in FIG. 11, the top and bottom pairs 51A, 53A of mounting members 5, 7 adjacent the top 22 and bottom 23 respectively of the mounting wall 3, can each employ mounting members 5A, 7A mounted back to back in the same channel 19B.

Figure 12:
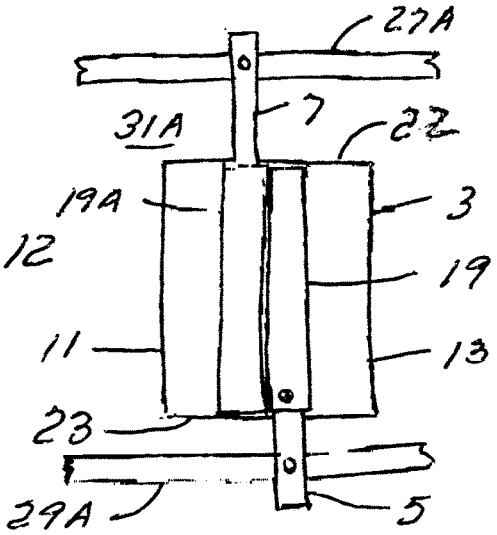
FIG. 12 is a broken, rear view of a mounting assembly mounted vertically.

The mounting members 5, 7 have been shown as being horizontal and moving horizontally past the sides 11, 13 of the mounting wall 3 of the mounting assembly 1. They can instead be mounted to move vertically from their channel 19, 19A past the top and bottom 22, 23 of the mounting wall 3, as shown in FIG. 12, to attach to spaced-apart, horizontal supports 27A, 29A locating the mounting wall 3 within the space 31A between the supports. Mounting members 5A, 7A shown in FIG. 7, mounting members 5B, 7B shown in FIG. 8, and mounting members 5C, 7C shown in FIG. 9 could be vertically mounted on the wall 3 to attach to horizontal supports such as supports 27A, 29A.

Figure 13:
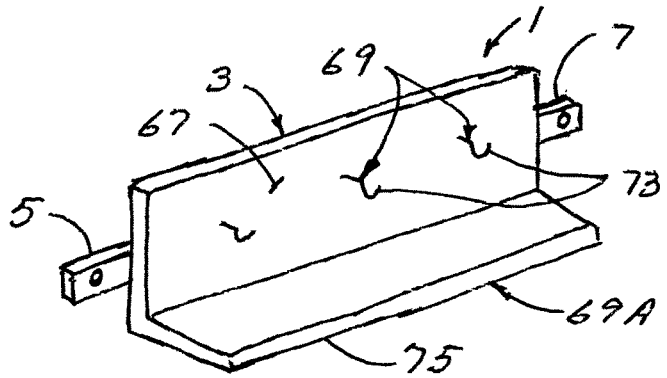
FIG. 13 is a perspective view of a mounting assembly with retaining means.

The mounting assembly 1 could be employed to display messages, directions, or other information by print directly on the front 67 of the mounting wall 3 or on paper or the like fastened to the front. Preferably the mounting assembly 1 is used to carry article retaining structure 69 on the front 67 of the mounting wall 3 as shown in FIG. 13. The article retaining structure 69 could be as simple as a few hooks 73 embedded into the front 67 of the mounting wall 3. Articles can be suspended from the hooks 73. The retaining structure 69A can instead comprise a shelf 75 extending forwardly from the bottom portion of the mounting wall 3. The shelf 75 is horizontal and retains articles thereon. The shelf 75 could be used with the hooks 73, as shown.

Figure 14:
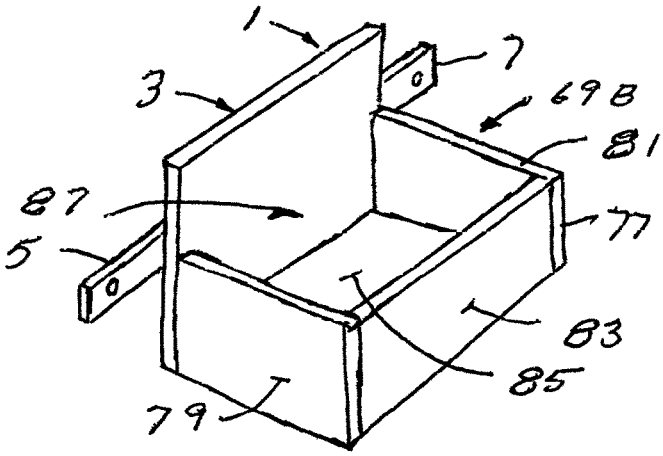
FIG. 14 is a perspective view of a mounting assembly with a container.

In another embodiment the retaining structure 69B can comprise a container 77 with the mounting wall 3 of the mounting assembly 1 forming the back wall of the container as shown in FIG. 14. The container 77 has side walls 79, 81 extending forwardly from the mounting wall 3, preferably from adjacent the side edges 11, 13 of the mounting wall 3. The front ends of the side walls 79, 81 are joined by a front wall 83. The container 77 has a bottom wall 85 closing the bottom end of the container. The top end 87 can be open. A pivoted lid (not shown) mounted on the mounting wall 3 can be provided to close the open end 87. Preferably the container has a quadratic cross-section.

Figure 15:
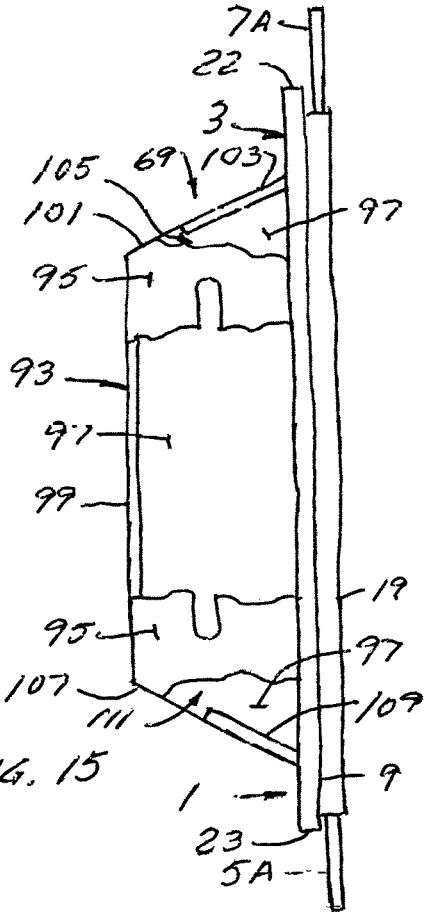
FIG. 15 is a side view of a mounting assembly with a container, partially broken away.

In another embodiment, the retaining structure 69 can comprise a narrow vertically elongated container 93 as shown in FIG. 15. The container 93 employs the mounting wall 3 of the mounting assembly 1 as its back wall and has side walls 95, 97 extending forwardly from the mounting wall 3. A front wall 99 connects the front of the side walls 95, 97. The mounting wall 3 has slidable mounting members 5A, 7A extending in opposite directions from a single channel 19 on the back 9 of the mounting wall 3 past the top 22 and bottom 23 of the mounting wall 3. The mounting members 5A, 7A could be mounted instead in individual channels 19, 19A located side by side on the back of the mounting wall 3, the mounting members 5A, 7A extending in opposite directions from the mounting wall. One of the mounting members 5A, 7A could be fixed to the mounting wall 3 so only one is slidable in the channel 19 on the mounting wall 3.

The container 93 has a top end 101 that is partly closed by a top wall 103 extending forwardly from the mounting wall 3 and leaving a top, front opening 105 in the top end 101. The bottom end 107 of the container is partly closed by a bottom wall 109 extending forwardly from the mounting wall 3 toward the front wall 99, and leaving a bottom, front opening 111 in the bottom end 107. Both the top and bottom ends 101 and 107 are preferably angled toward each other.

Figure 16:
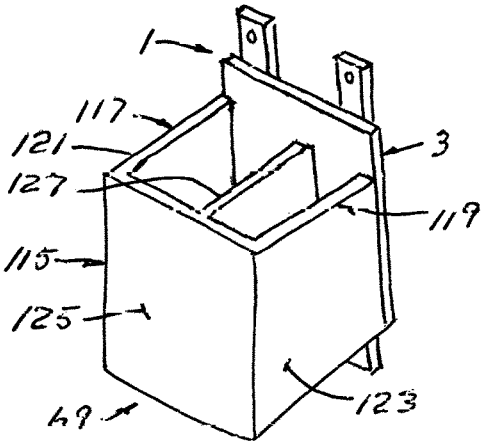
FIG. 16 is a perspective view of a mounting assembly with two containers.

In a further embodiment, as shown in FIG. 16, the retaining structure 69 on the mounting assembly 1 can comprise a container 115 having at least two side-by-side sub-containers 117, 119 with different capacities. The container 115 incorporates the mounting wall 3 as a back wall for both sub containers 117, 119. The container 115 has side walls 121, 123 extending forwardly from the mounting wall 3, the fronts of the side walls 121, 123 joined by a front wall 125. A partition wall 127 can extend between the mounting wall 3 and the front wall 125 to divide the container into the large sub-container 117 and small sub-container 119. The sub-containers 117, 119 can be open at their top end and closed at their bottom end. Alternatively, they can be partially closed by end walls extending forwardly from mounting wall 3 toward the front wall 125 as shown by end walls 103, 109 in FIG. 15.

The container 115 has top and bottom sets of mounting members 5, 7 (shown) or 5*a*, 7A, each set carried by a single tubular channel (not shown) mounted on the back of the mounting wall 3. The mounting members extend vertically the mounting wall 3. With the mounting members 5, 7 attached at their free ends to spaced-apart supports, the container 115 is retained in the space between the supports.

Figure 18:
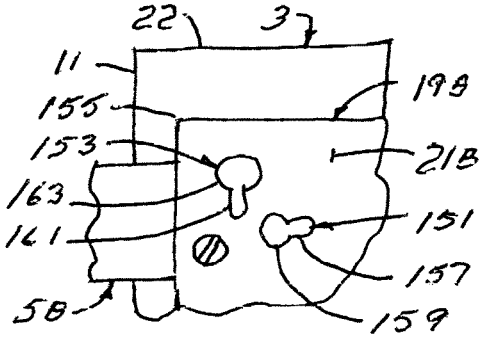
FIG. 18 is a detail view of the keyhole slot.
Figure 17:
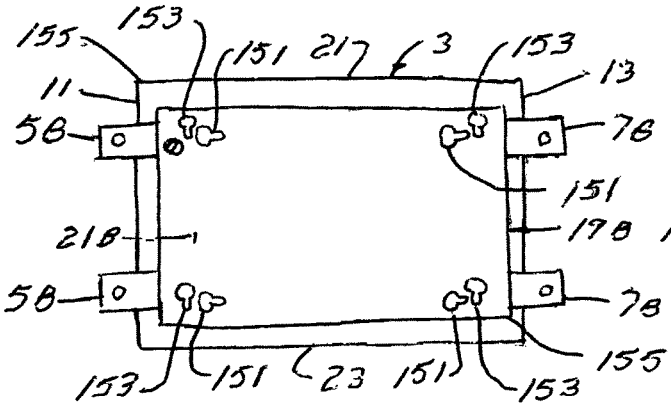
FIG. 17 is rear view of mounting assembly with keyhole slots on the outer wall of the channel member.

With a mounting assembly 1 having a long, wide mounting wall 3 as shown in FIG. 17, the mounting wall 3 could carry wide mounting members 5B, 7B that extend vertically, or horizontally as shown. When horizontal, the mounting wall 21B of the wide channel member 19B in which the mounting members 5B, 7B are slidably mounted, could be provided with vertical and horizontal keyhole slots 151, 153 at the corners 155 of the mounting wall 3. The keyhole slots, shown in detail in FIG. 18, have one slot 151 at each corner 155 with each slot having a horizontal narrow tail 157 extending from a wider circular hole 159. The tails 157 all extend in the same direction, toward the one side 13 of the mounting wall 3, as shown, or toward the other side 11. The other set of keyhole slots 153 have the narrow tail 161 extending from a wider circular hole 163, the tails 161 all extending in the same direction, down toward the bottom end 23 of the wall 3 as shown. The keyhole slots permit the mounting assembly 1 to be fastened directly to screws (not shown) which screws are fastened directly to thick supports such as solid wood doors in cabinets, the heads of the screws slightly above the supports as is known to be able to extend through the circular holes 158 or 163 in the keyhole slots 151 or 153 respectively. The mounting members 5B, 7B are not needed in this case and since they are in the way, they could be removed and stored until needed. The keyhole slots add versatility to the mounting assemblies allowing them to be mounted in open space between supports or directly against supports such as thick panels. The keyhole slots 151, 153 could be employed in a similar manner on the mounting wall of a channel member 19C holding mounting members 5C, 7C.

Figure 19:
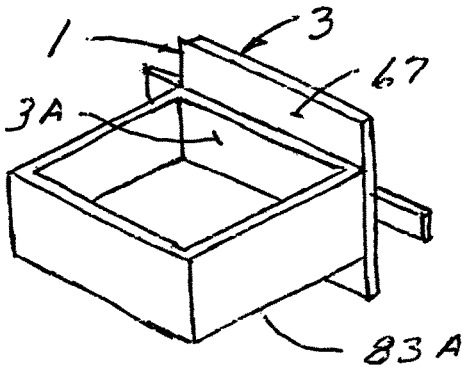
FIG. 19 is a perspective view of another embodiment of the mounting assembly and container.

The containers have been described above as incorporating the mounting assembly in its structure, with the mounting wall of the mounting assembly forming an integral part of the container. A separate container 83A with its own mounting wall 3A, forming the back wall of the container, could of course be attached by suitable means to the front 67 of the mounting wall 3 of the mounting assembly 1 as shown in FIG. 19.

Figure 20:
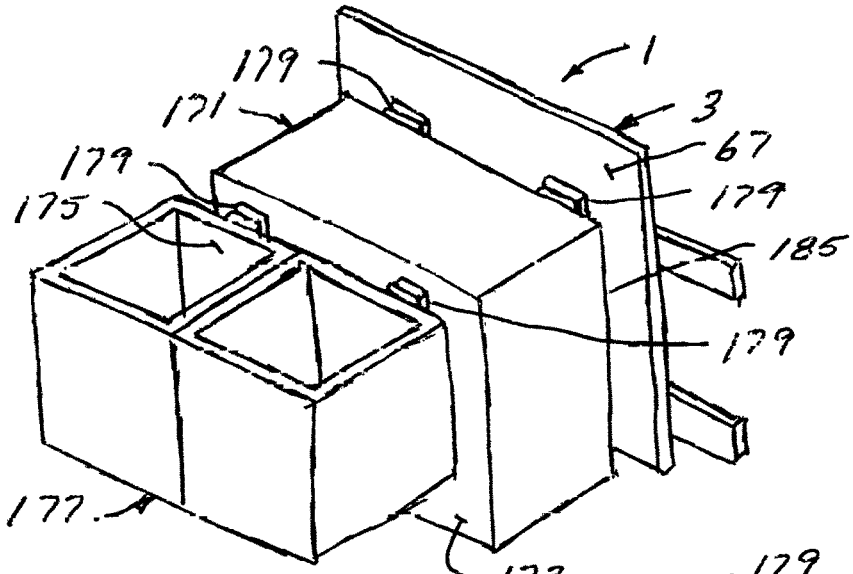
FIG. 20 is a perspective view of the mounting assembly and a waste container.
Figure 21:
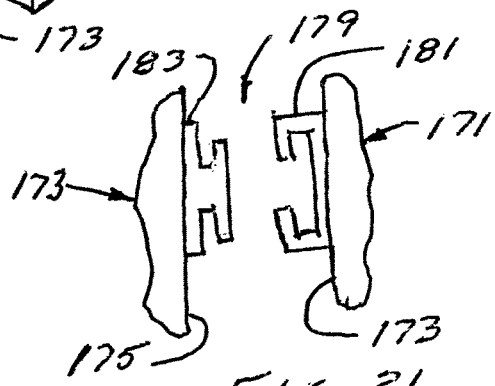
FIG. 21 is a detail, cross-section view of the connectors used on the assembly shown in FIG. 20.

The containers, particularly wide and/or long containers can be provided with waste bins carried by containers. As shown in FIGS. 20 and 21 a waste bin 171 is attached by a mounting wall 173 to the mounting wall 175 of a container 177. Interconnections 179 are provided comprising a slotted channel member 181 on mounting wall 173 and a T-member 183 on the other mounting wall 175 which T-member fits snugly within the channel member 181 to connect the walls together. Two interconnections 179 are shown. The slotted channel member 181 and T-member 183 could be alternatively mounted on the mounting walls 175, 173 respectively. Both the channel and T members 181, 183 are elongated strips which could be adhesively attached to the waste bin 171 and container 177 respectively. Alternatively, they could be molded integraly with the waste bin and container. The mounting assembly 1 can be attached by the front 67 of its mounting wall 3 to the front wall 185 of the waste bin 171 by additional interconnections 179. Each interconnection 179 would have a slotted channel member 181 on one of the mounting wall 3 and the front wall 185 and the T member would be on the other wall opposite the channel member 181.

Figure 22:
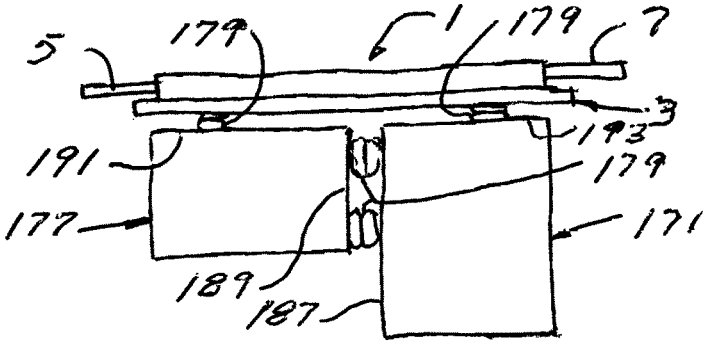
FIG. 22 is a top view of another arrangement of a container and a waste container.

Alternatively, as shown in FIG. 22 the waste bin 171 could be mounted by a side wall 187 against a side wall 189 of the container 177 using interconnections 179 on the side walls. The mounting assembly 1, with its mounting wall 3, could form the mounting wall of the container. Alternatively, it could, as shown, be attached to the mounting wall 191 of the container. The container 177 and bin 171 could be designed to have their mounting walls 191, 193 aligned when the side wall 187 of the bin 171 is attached to a 189 side wall of the container. The mounting assembly 1, carrying the mounting members 5, 7, could extend across the mounting walls 191, 193 of the container 177 and bin 171 and be attached to the mounting walls with interconnections 179.

I claim:

1. A mounting assembly having: a mounting wall, the mounting wall having two opposed sides and a top and bottom connecting the sides; a channel on the wall extending between the sides of the wall, the channel having first and second open ends; a first mounting member slidably mounted in the channel and extending out from the first open end of the channel past one of the opposed sides of the wall to terminate in a first front edge spaced from the wall, a second mounting member slidably mounted in the channel and extending out from the second open end of the channel past the other of the opposed sides of the wall to terminate in a second front edge spaced from the wall, the mounting members extending in opposite directions from each other; the channel covering a substantial portion of the mounting wall, the channel extending from near the top of the mounting wall to near the bottom of the mounting wall, wherein the first and second mounting members each have top and bottom arms extending outwardly from a main body within the channel, each arm ending in a front edge, each arm having fastener receiving means adjacent its front edge.

* * * * *